US005415356A

United States Patent [19]

Callaghan

[11] Patent Number: 5,415,356

[45] Date of Patent: May 16, 1995

[54] REDUCING ASSEMBLY FOR ROTARY DRUM MIXERS

[75] Inventor: William J. Callaghan, Eau Claire, Wis.

[73] Assignee: Continental Products Corporation, Osseo, Wis.

[21] Appl. No.: 39,981

[22] Filed: Mar. 30, 1993

[51] Int. Cl.[6] ..... B02C 13/28; B02C 13/00

[52] U.S. Cl. ..... 241/101.8; 241/188.1; 241/282.1; 241/285.3; 241/292.1

[58] Field of Search ..... 241/98, 101.01, 101.2, 241/101.8, 188.1, 189.1, 277, 282.1, 282.2, 285.3, 292.1; 366/155

[56] References Cited

U.S. PATENT DOCUMENTS

| | | | |
|---|---|---|---|
| 1,825,261 | 9/1931 | Burns et al. | 241/101.8 X |
| 2,492,421 | 12/1949 | Golben | 241/101.8 X |
| 3,088,711 | 5/1963 | Phillips . | |
| 3,147,956 | 9/1964 | Phillips . | |
| 3,259,372 | 7/1966 | Phillips . | |
| 3,269,707 | 8/1966 | Phillips . | |
| 3,552,721 | 1/1971 | Phillips . | |
| 3,558,108 | 1/1971 | Jackson . | |
| 3,584,334 | 6/1971 | Moriya | 241/188.1 |
| 3,752,445 | 8/1973 | Nowak . | |
| 3,825,193 | 7/1974 | Lodige et al. | 241/188.1 X |
| 3,829,066 | 8/1974 | Phillips . | |
| 3,897,934 | 8/1975 | Phillips . | |
| 4,026,528 | 5/1977 | Kline et al. | 241/101.8 X |
| 4,074,869 | 2/1978 | Johnson | 241/188.1 X |
| 4,213,571 | 7/1980 | Deardorff | 241/101.8 X |
| 4,214,713 | 7/1980 | Wright | 241/285.3 X |

FOREIGN PATENT DOCUMENTS

| | | | |
|---|---|---|---|
| 1084970 | 7/1960 | Germany | 241/101.8 |

OTHER PUBLICATIONS

Drawing (1 Sheet) *Normal Slide Positions for Load-In, Mix and Discharge, Continental Products Corporation.*

Brochure (1 Sheet-2 Sides) *If You Mix Feed, Either Custom or Manufactured Blends, This Message is Important to Your Profit,* Continental Products Corporation.

Brochure (5 Pages) *Jakel Tumble Mixer,* Jakel Co., Inc.

Brochure (4 Pages) *The Continental "Rollo-Mixer" Mark V,* Continental Products Corporation.

Brochure (1 Sheet-1 Side) *If You Mix Feed, Either Custom or Manufactured, This Message is Important to Your Profit,* Continental Products Corporation.

*Primary Examiner*—Timothy V. Eley

*Attorney, Agent, or Firm*—Kinney & Lange

[57] ABSTRACT

A reducing assembly for a rotary drum mixer is provided. The rotary drum mixer has a frame, an open-ended drum rotatably supported by the frame and a stationary hood enclosing the open-end of the drum. In accordance with the present invention, a housing is mounted to the stationary hood such that reducing means within the housing reduces the product matter therein to a desired uniform particulate size.

15 Claims, 5 Drawing Sheets

2
38
94
56
52
10
12
36
78
20
126
124
80
18
16
2
32
28

REDUCING ASSEMBLY FOR ROTARY DRUM MIXERS

BACKGROUND OF THE INVENTION

The present invention relates to rotary drum mixers for mixing dry particulate matter and, in particular, it relates to reducing assemblies for reducing the size of a product being mixed in a rotary drum mixer.

Rotary drum mixers for mixing product matter in particulate form are known in the art. Rotary drum mixers typically include a rotatable open-ended drum and a stationary hopper positioned on or adjacent the mixer for introducing product matter into the drum. The drum includes front inclined troughs for directing the product matter in a direction away from the open end and rear inclined troughs for directing product matter in the opposite direction. The multi-directional troughs mix the product matter to a desired blend as the drum rotates.

Generally, a stationary hood encloses the drum open end and turbine blades fixedly attached to the drum elevate product matter within the stationary hood. The turbine blades direct the product matter to a discharge hopper mounted on the hood. A seal member between an annular flange on the stationary hood abuts against the outside of the rotating drum. Such rotary drum mixers are illustrated, for example, in U.S. Pat. Nos. 3,552,721 and 3,897,934.

There are times when a rotary drum mixer user desires to mix product matter, then have the particulate material of the product matter reduced in size and then again mix the reduced-size particulate material. In order to accomplish such a task, the rotary drum mixer is loaded with the original product matter, operated until all product matter is mixed to a desired blend and then emptied. The mixed product matter is then transported either within or outside the mixing facility to a device, such as a crushing mill or roll, which can accomplish the particulate size reduction. Then, the size-reduced product matter is transported back to the mixing facility, loaded into the mixer and mixed until the desired blend is once again accomplished. Such a time intensive process as described above results in increased expenditures in the form of increased labor, lower productivity and increased plant size due to need for additional machinery, and also requires additional handling and enhances the possibility of contamination of the product matter.

In the Phillips U.S. Pat. No. 3,829,066, a particulate material mixing machine is described. Instead of the multi-directional troughs as described above, the mixing machine of the Phillips '066 patent describes an auger-type assembly mounted entirely within the drum and having a housing, a rotating spiral blade for moving product matter through the housing and a rotating fan to fling the product matter rearwardly to descend into the drum substantially throughout the axial length thereof. While the spiral blade can include extending lugs to help break up chunks and clumps of product matter within the housing, the spiral blade does not uniformly reduce the particulate size of the product matter being mixed. The stated object of the Phillips '066 patent disclosure is to increase the speed that product matter is mixed.

SUMMARY OF THE INVENTION

The present invention is a reducing assembly for a rotary drum mixing system. A rotary drum mixing system mixes product matter in a particulate form and includes a frame, an open-ended drum rotatably supported by the frame and a stationary hood enclosing the open-end of the drum.

The reducing assembly according to the present invention comprises a housing mounted to the stationary hood. A guide mechanism attached to the housing extends into the drum and guides product matter from the drum into the housing. A reducing mechanism within the housing reduces the product matter therein to a desired uniform particulate size. A discharge mechanism discharges the product matter from the housing into the rotating drum.

In an embodiment, the housing is substantially cylindrical and the hood bisects the housing into a first semi-cylindrical portion and a second semi-cylindrical portion such that the first semi-cylindrical portion is positioned entirely within the drum and the second semi-cylindrical portion is hingedly connected to the first semi-cylindrical portion. In addition, the amount of product matter entering the housing can be controlled by a door connected to the housing, the door being movable to a position whereby product matter is prevented from entering the housing.

In a further embodiment of the present invention, a rotatable shaft is positioned within the housing and a plurality of bearings are mounted about the shaft. A plurality of blades attached to the shaft rotate within the housing thereby reducing the product matter therein to a desired uniform particulate size.

Furthermore, the housing can include a main chamber through which the product matter travels. In this case, a seal chamber is provided within the housing to seal at least one of the bearings from the main chamber.

DETAILED DESCRIPTION OF THE PREFERRED EMBODIMENTS

Figure 1:
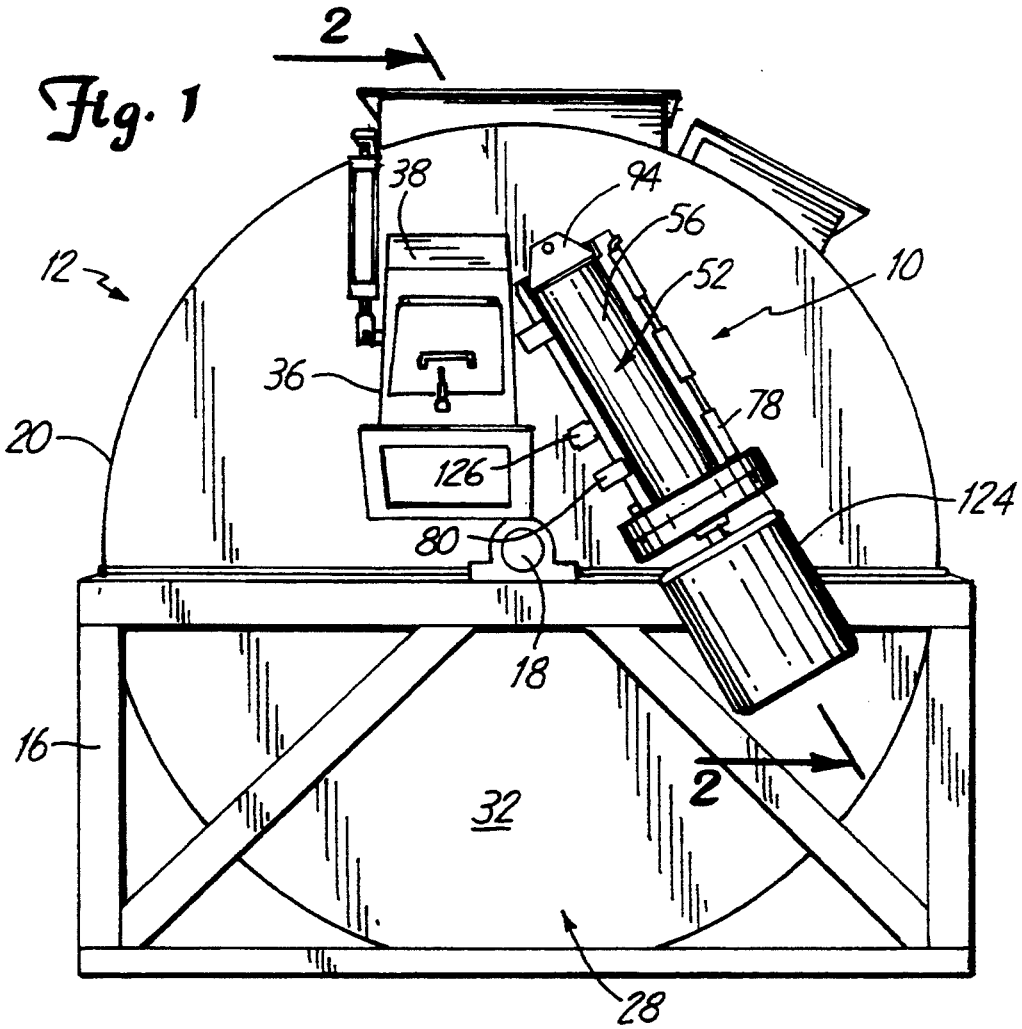
FIG. 1 illustrates a front end view of a reducing assembly of a rotary drum mixing system in accordance with the present invention.

FIG. 1 illustrates a reducing assembly, designated generally at 10, in accordance with the present invention, of a rotary drum mixing system 12 for mixing product matter 14 in a particulate form. In addition to the present invention, the drawings illustrate the rotary drum mixing system 12 such as taught in U.S. Pat. Nos. 3,552,721 and 3,897,934, both of which are hereby incorporated herein by reference.

Figure 2:
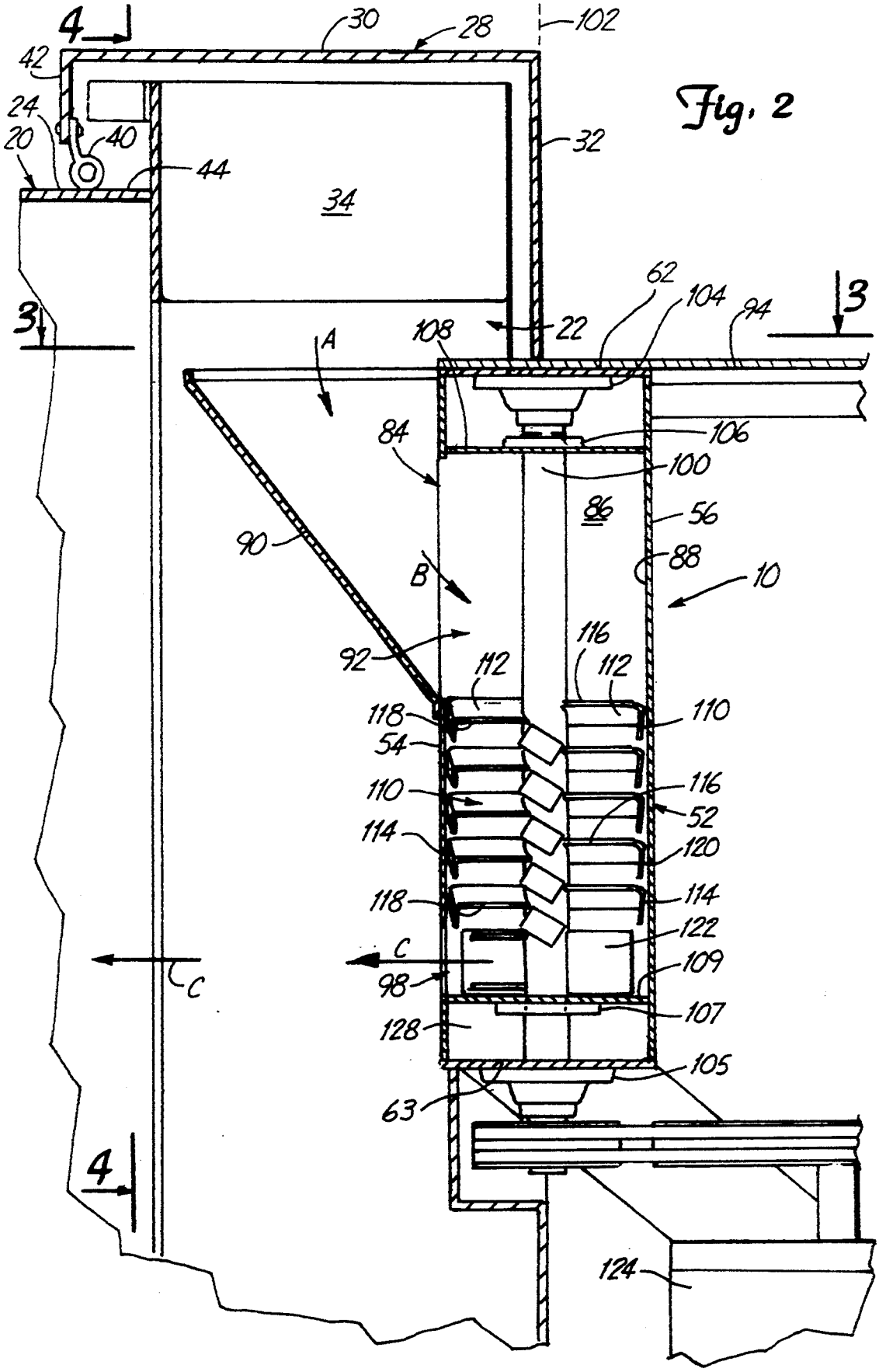
FIG. 2 illustrates a sectional view of a reducing assembly of the present invention taken along line 2—2 in FIG. 1.

The mixing system 12 includes a frame 16 supporting a shaft 18 and a cylindrical drum 20 supported on the shaft 18. As illustrated in FIG. 2, the drum 20 includes an open front end 22 and a closed rear end (not shown). Furthermore, the drum 20 is rotatable on a horizontal axis about the shaft 18 and includes a tubular outer drum wall 24 and a drum rear wall (not shown). Preferably, the drum 20 rotates at approximately 3 revolutions per minute.

The drum 20 further includes front inclined troughs (not shown) for directing the product matter 14 in a direction away from the open end 22 and rear inclined troughs (not shown) for directing product matter 14 in the opposite direction. The multidirectional troughs mix the product matter 14 to a desired blend when the drum 20 is rotated.

As illustrated in FIG. 2, a stationary hood 28 is provided for covering the open end 22 of the drum 20 and has a tubular outer hood wall 30 and an end wall 32. The outer hood wall 30 has a larger diameter than the outer drum wall 24 and is concentrically located about the open end 22 of the drum 20.

A plurality of turbine blades 34 fixedly attached to the drum 20 elevate the product matter 14 within the stationary hood 28 as the drum 20 is rotated. The turbine blades 34 direct the product matter 14 to a discharge hopper 36, as illustrated in FIGS. 1 and 4, mounted on the stationary hood 28.

Figure 4:
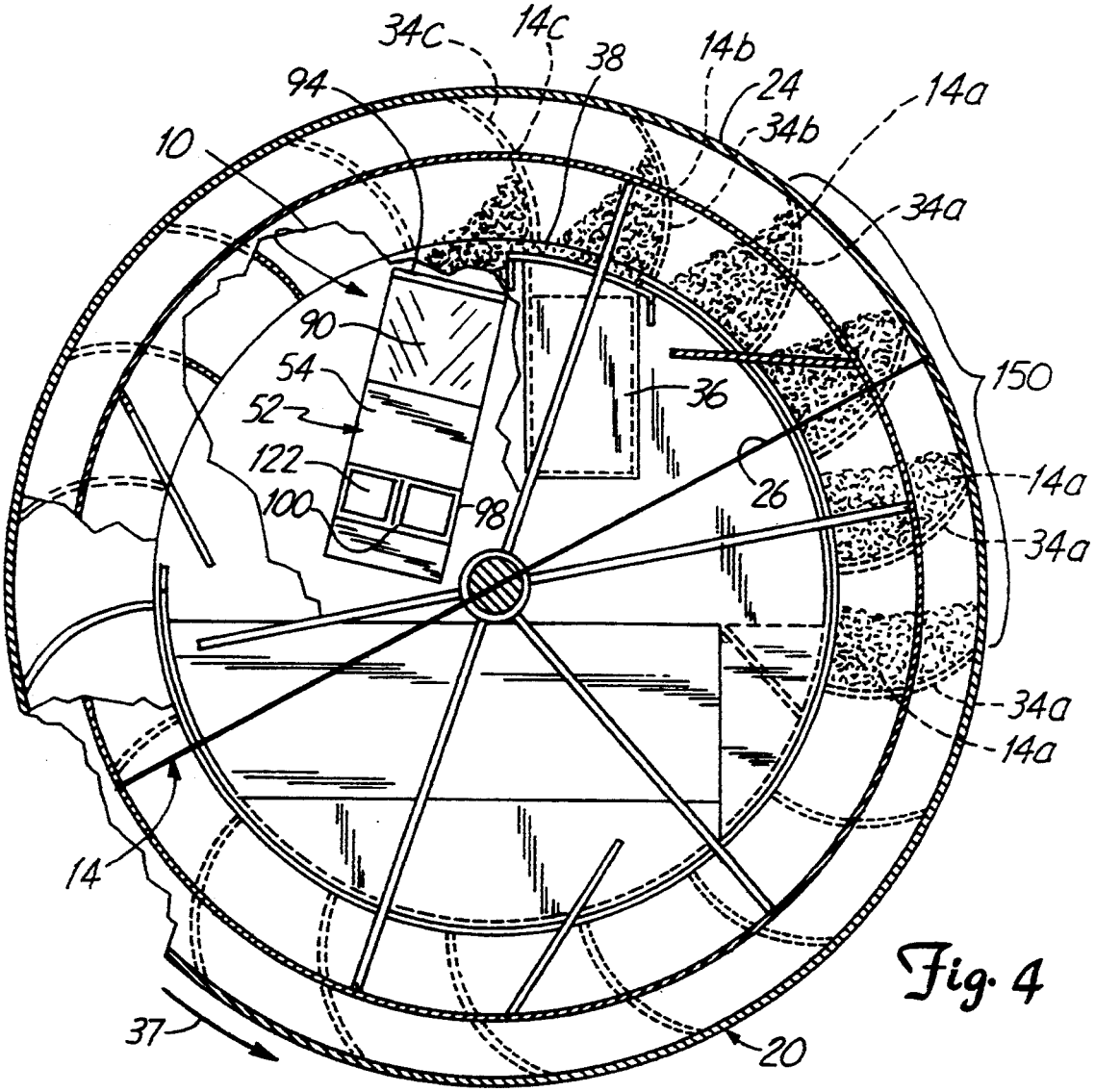
FIG. 4 illustrates a sectional view of the mixing assembly from the interior of the drum (as taken generally along line 4—4 i FIG. 2), including the discharge hopper and the reducing assembly of the present invention, with portions of the view being broken away to more fully illustrate other portions which direct product matter from the drum to the discharge hopper and the reducing assembly.

The drum is rotated in direction of arrow 37, as illustrated in FIG. 4. It should be noted that as the product matter 14 is being mixed in the drum 20, as illustrated in FIG. 4, the rotation of the drum 20 and the troughs moving and lifting the product matter 14 tend to cause the surface level 26 of the product matter 14 within the drum 20 to be offset from the horizontal.

As illustrated in FIG. 1, a cover 38 mounted on the stationary hood 28 is slidable to open the discharge hopper 36 to receive the product matter 14 or to close so that the product matter 14 is retained within the mixing system 12. If the cover 38 (e.g., a sliding door panel) over the discharge hopper 36 is open, the product matter 14 will be discharged from the mixing system 12. If the cover 38 is closed, the product matter 14 will be directed elsewhere within the mixing system 12 as described further below.

As illustrated in FIG. 2, a seal member 40 between an annular flange 42 on the stationary hood 28 abuts against an outside cylindrical surface 44 of the outer drum wall 24 of the rotating drum 20 to seal the product matter 14 within the drum 20. Although the seal member 40 is illustrated as being a resilient annular seal member, other seals which seal the product matter 14 within the drum 20 are within the scope of the present invention.

Figure 3:
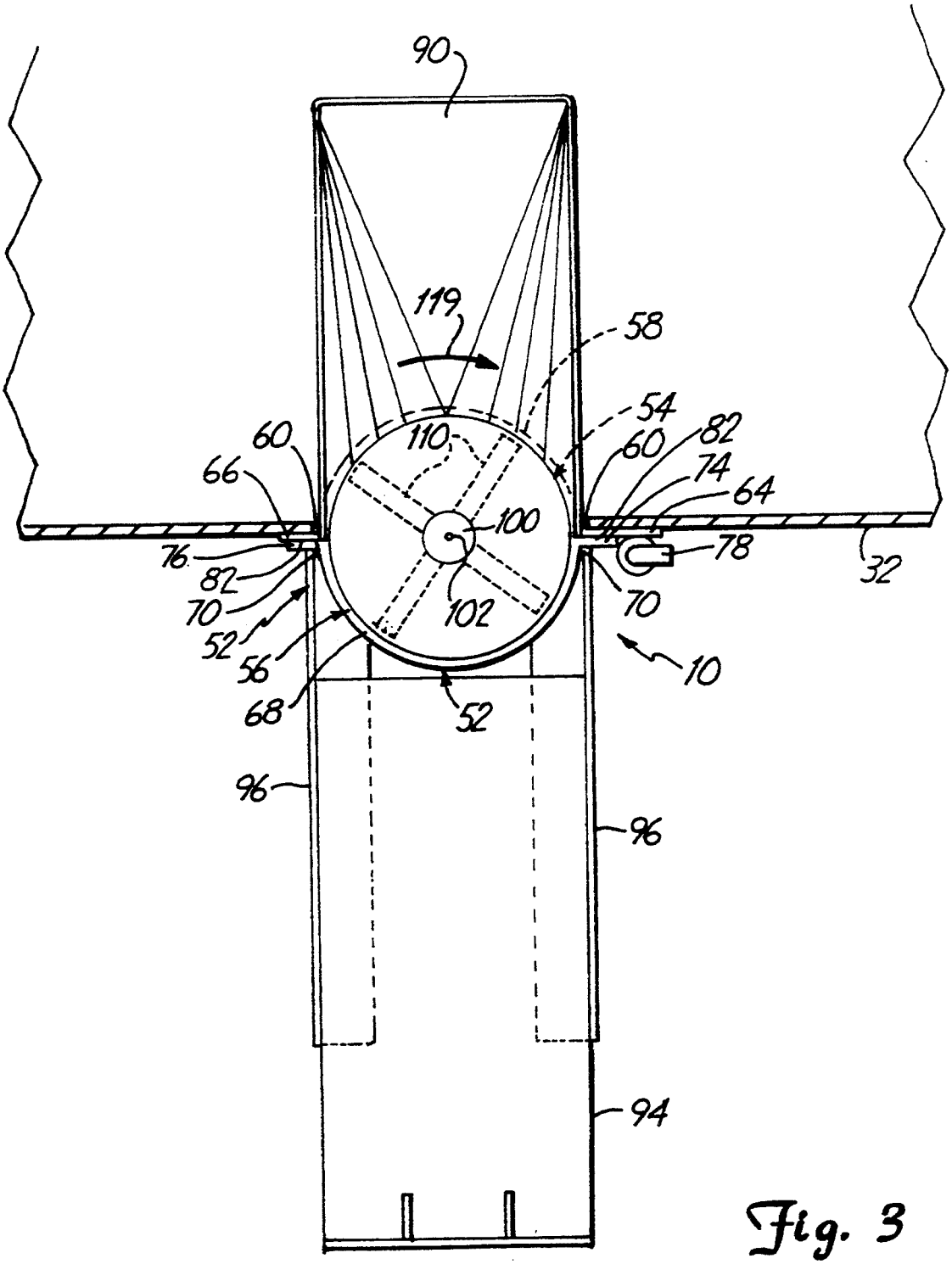
FIG. 3 illustrates a sectional view of the reducing assembly of the present invention taken along line 3—3 in FIG. 2.

In accordance with the present invention and as illustrated in FIGS. 2 and 3, a reducing assembly 10 mounted to the stationary hood 28 is provided to specifically, and generally uniformly, reduce the particulate size of the product matter 14. As illustrated in FIG. 1, the reducing assembly 10 is mounted such that it is tilted approximately 30° off vertical so that the product matter 14 in the reducing assembly 10 can utilize gravity to assist in moving the product matter 14 through the reducing assembly 10. In addition, the tilting of the reducing assembly assures that the product matter 14 being ejected by the reducing assembly 10 can move back into the drum 20 over the surface level 26 of the mixing product matter 14 and without substantial interference from that product matter 14. Although the tilt angle has been described as being approximately 30°, any tilt angle which accomplishes the above results is within the scope of the present invention.

As illustrated in FIGS. 2 and 3, the reducing assembly 10 includes a substantially cylindrical housing 52 having an inner portion 54, an outer portion 56 and a pair of end walls 62, 63. As illustrated in FIG. 3, the inner portion 54 includes an inner semi-cylindrical member 58 having a pair of longitudinal edges 60, a first inner flange member 64 and a second inner flange member 66. The first inner flange 64 and the second inner flange 66 extend substantially along the lengths of the longitudinal edges 60 of the inner member 58.

The inner portion 54 is releasably secured to the stationary hood 28 by suitable fastening means such as a plurality of bolts (not shown) removably connecting the first and second inner flanges 64, 66 to the end wall 32 of the stationary hood 28.

The outer portion 56 includes an outer semi-cylindrical member 68 having a pair of longitudinal edges 70, a first outer flange member 74 and a second outer flange member 76. The first outer flange 74 and the second outer flange 76 extend substantially along the lengths of the longitudinal edges 70 of the outer member 56.

The outer portion 56 is secured to the inner portion 54 by a hinge 78 extending along the longitudinal length of the first inner flange 64 and the first outer flange 74. The hinge 78, being of any known construction, allows the housing 52 to be opened for inspection or maintenance without the need to remove the housing 52 from the stationary hood 28.

The end walls 62, 63 are mounted at each end of the housing 52 between the inner portion 54 and the outer portion 56. The end walls 62, 63 effectively close the housing 52 thereby creating a substantially cylindrical interior as will be discussed later.

Figure 5:
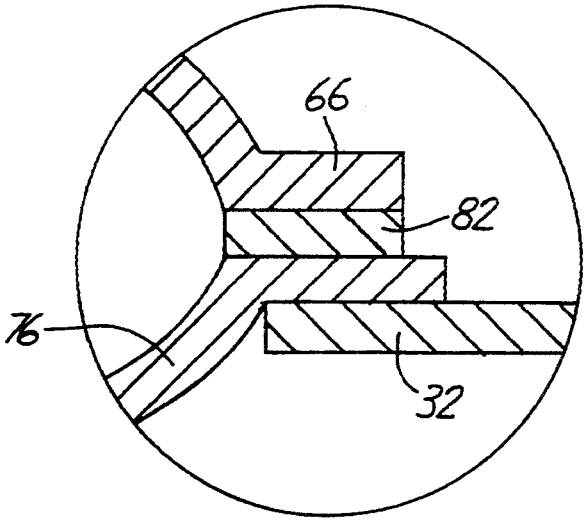
FIG. 5 is an enlarged sectional view of a portion of the reducing assembly of the present invention.

One or more clamps 80 are mounted on the stationary hood 28 approximate the reducing assembly 10 to clamp the outer portion 56 against the inner portion 54. As illustrated in FIGS. 3 and 5, a seal 82 positioned between the inner and outer portions 54, 56 discourages the product matter 14 from escaping the reducing assembly 10.

As illustrated in FIG. 2, the inner portion 54 includes an approximately 180° receiving opening 84 to allow the product matter 14 to enter a cylindrical main chamber 86 of the housing 52. An inside surface 88 of the main chamber 86 can be coated with abrasion resistant substances to reduce wear of the inside surface 88 and decrease maintenance. In addition, it is within the scope of the present invention to coat the inside surface 88 with a substance such as TEFLON to insure a high release of the product matter 14 which comes in contact with the inside surface 88.

A transition chute 90 mounted on the inner portion 54 extends into the rotating drum 20 adjacent the discharge hopper 36. The transition chute 90 guides the product matter 14 falling from the turbine blades 34 of the rotating drum 20 through the receiving opening 84 into a receiving area 92 in the main chamber 86 of the housing 52. The transition chute 90 is preferably shaped as a trough but it is within the scope of the present invention to include any shape or guide structure which will guide the falling product matter 14 through the receiving opening 84 and into the main chamber 86.

A chute door 94 is positioned over the transition chute 90 to control the amount of the product matter 14 entering the main chamber 86. As illustrated in FIG. 3, the chute door 94 is mounted on guides 96 on the housing 52 such that the chute door 94 is movable between an open position and a closed position. In the closed position, the chute door 94 extends over and covers the top of the transition chute 90 so that the product matter 14 is prevented from entering the chamber 86 in the housing 52.

As illustrated in FIGS. 2 and 4, the inner portion 52 also includes a discharge opening 98 extending approximately 180° around the inner portion 52 to allow the product matter 14 to exit the main chamber 86 of the housing 52. The discharge opening 98 is situated such that the level of product matter 14 being mixed within the drum 20 (level 26 in FIG. 4) will not interfere with the reduced sized product matter being discharged from the reducing assembly 10. The actual operation of the reducing assembly 10 and the discharge of the product matter 14 therefrom will be discussed in greater detail below.

The reducing assembly 10 of the present invention further includes a rotatable shaft 100 having a longitudinal axis 102 and extending between the end walls 62, 63 of the housing 52. The shaft 100 is mounted on a pair of bearings 104, 105 which allow the shaft 100 to freely rotate about its longitudinal axis 102. The bearings 104, 105 are positioned adjacent the end walls 62, 63, respectively,. Furthermore, the bearing 104 is mounted inside the housing 52 while the bearing 105 is positioned outside of the housing 52. The bearings 104,105 can include ball bearings, tapered roller bearings or other conventional bearings to provide support of the shaft 100 within the housing 52.

A bearing seal 106, 107 and a blocking plate 108, 109 are placed within the housing 52 at each end, respectively, of the shaft 100. The bearing seal 106 and the blocking plate 108 are secured between the bearing 104 and the receiving opening 84 of the inner portion 54 and the bearing seal 107 and the blocking plate 109 are secured between the bearing 105 and the discharge opening 98. The bearing seals 106, 107 and the blocking plates 108, 109 define the longitudinal extent of the main chamber 86 and serve to block any product matter 14 from reaching the bearings 104, 105.

To effectively block the product matter 14, the outside diameters of the blocking plates 108, 109 are approximately equal to the inside diameter of the housing 52 and the plates 108, 109 are sealably affixed to the housing 52 about their peripheries. Additionally, the inside diameter of the bearing seals 106, 107 are approximately equal to the outside diameter of the shaft 100 such that the bearing seals 106, 107 rest against the shaft 100. The bearing seals 106, 107 are formed of a resilient material to seal around the shaft 100. Construction of the bearing seals 106, 107 in such a manner allow the bearing seals 106, 107 to effectively inhibit travel of the product matter 14 from the main chamber 86 along the shaft 100, while the shaft 100 rotates.

During the reducing process as will be discussed in detail below, the product matter 14 can be reduced to very fine particulate material. Therefore, to further protect the bearing 105, a seal chamber 128 is positioned between the end wall 63 and the blocking plate 109. The seal chamber 128 assists in blocking the size reduced product matter 14 from the bearing 105 by creating an area which the product matter 14 can collect if the product matter 14 unexpectedly passes around the bearing seal 109 and the bearing plate 107 during operation.

A plurality of material reduction rotor blades 110 are positioned within the main chamber 86 below the receiving area 92. The rotor blades 110 are attached to the shaft 100 and rotate with the shaft 100. Each rotor blade 110 includes a main body portion 112, an outer flange 114 on an outer end of the blade, a leading edge 116 and a trailing edge 118. The main body portion 112 extends from the shaft 100 to a point closely adjacent the inside surface 88 of the main chamber 86, e.g. extends to a point approximately one-eighth inch to one-sixteenth inch from the inside surface 88. The clearance between the blades' outer end and the inside surface 88 of the main chamber 86 is a function of the desired size of the product matter to be processed. The smaller the clearance, the smaller the product matter will be reduced in particulate size by the reducing assembly 10.

The shaft 100 is rotated in direction of arrow 119 in FIG. 3. The main body portion 112 of each rotor blade 110 is preferably tilted in a relative upward direction such that the leading edge 116 is higher within the main chamber 86 than the trailing edge 118. Such tilting of the main body portion 112 assists in moving the product matter 14 through the main chamber 86 and toward the discharge opening 98.

The leading cutting edge 116 extends substantially the entire length of the main body portion 112 of each rotor blade 110. The leading cutting edge 116 contacts the product matter 14 traveling through the main chamber 86 and reduces the size of the product matter 14 therein.

The flange 114 is positioned between the main body portion 112 and the inside surface 88 of the main chamber 86. The flange 114 includes a cutting edge 120 which is a continuation of the leading edge 116 described above, but set at a different angle as it engages the product matter 14 during rotation. The cutting edge 120 otherwise contacts the product matter 14 in the same manner as the leading edge 116 and reduces its size.

Figure 6:
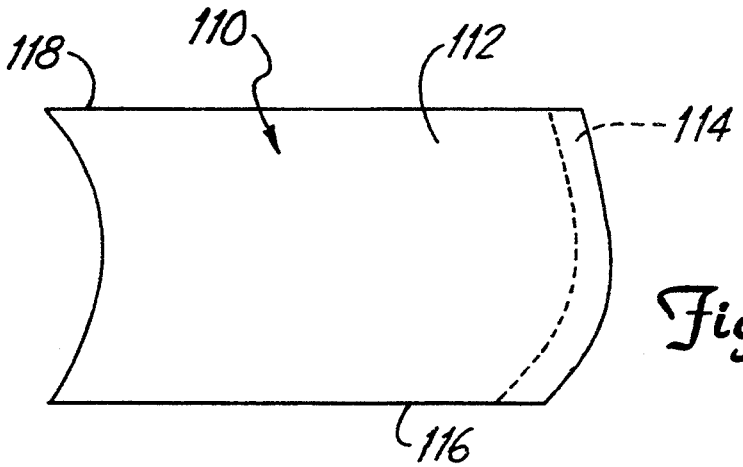
FIG. 6 is a top view of a rotor blade of the reducing assembly of the present invention.
Figure 7:
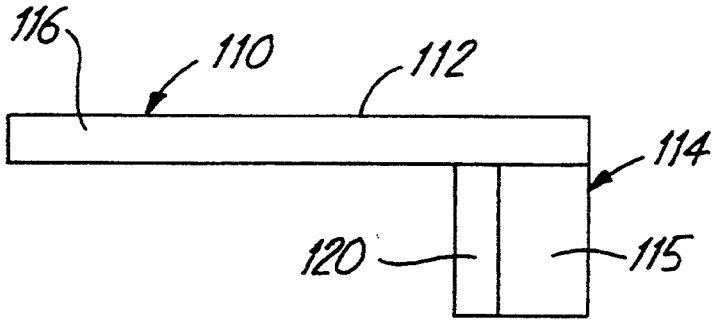
FIG. 7 is a side view of a rotor blade of the reducing assembly of the present invention.

As illustrated in FIGS. 6 and 7, the flange 114 also includes an outer surface 115 closely adjacent to the inside surface 88 of the main chamber 86. At least a portion of the outer surface 115 has a curvature approximately equal to the curvature of the inside surface 88 therefore allowing the flange 114 to travel directly adjacent the inside surface 88. By providing an outer surface 115 as described, surface area for driving the product matter 14 against the inside surface 88 is increased. Therefore, a majority of the size reduction of the product matter 14 is caused by the flange 114 wiping the product matter 14 against the inside surface 88 of the main chamber 86.

The rotor blades 110 are arranged within the main chamber 86 such that a first pair of blades rotor 110 opposite each other about the shaft 100 have substantially parallel leading edges 116. An adjacent pair of rotor blades 110 are similarly arranged but positioned 90° from the first pair of rotor blades 110 such that the leading edges 116 of the adjacent pair of rotor blades 110 are approximately perpendicular to the leading edges 116 of the first pair of rotor blades 110 (see rotor blades 110 shown in phantom in FIG. 3). Additionally, the adjacent pair of blades rotor 110 are positioned below the other pair of rotor blades 110 such that together with the main body portion tilt, the product matter 14 is driven through the main chamber 86.

As with the inside surface 88 of the main chamber 86, the rotor blades 110 can be coated with abrasion resistant substances to increase the life of the rotor blades 110. In addition, it is within the scope of the present invention to coat the rotor blades 110 with a substance such as TEFLON to insure a high release of the product matter 14 which comes in contact with the rotor blades 110.

Below the rotor blades 110 within the main chamber 86, a plurality of paddles 122 are mounted to the shaft 100 directly adjacent the discharge opening 98. In the preferred embodiment, three paddles 122 are arranged equidistant around the shaft 100. The paddles 122 rotate with the shaft 100 and drive the reduced sized product matter back into the rotating drum 20 through discharge opening 98.

Outside the housing 52 and secured to the frame 16, a motor 124 is positioned to drive the shaft 100 (through suitable drive ratio control means, such as a belt and drive assembly 125) at approximately 3500 revolutions per minute. The motor 124 is of any known construction and can be variable speed if desired.

As illustrated in FIG. 1, a proximity sensor 126 can be positioned between the outer portion 56 and the stationary hood 28. The proximity sensor 126 senses when the outer portion 56 is opened a certain amount about the hinge 78. When such the outer portion 56 is opened a predetermined amount, the proximity sensor 126 causes the motor 124 to stop thereby ultimately causing the rotation of the rotor blades 110 and paddles 122 within the housing 52 to cease.

In operation of the mixing system 12 (wherein uniform reduction of the size of the product matter 14 being mixed within the mixing system 12 is required), the cover 38 over the discharge hopper 36 is moved to its closed position and the chute door 94 of the reducing assembly 10 is moved to a position which allows the product matter 14 to be introduced into the housing 52 of the reducing assembly 10. The product matter 14 is then introduced into the rotating drum 20 and is mixed by the multi-directional troughs to a desired blend.

As the product matter is being mixed, the turbine blades 34 mounted within the drum 20 lift the product matter within the stationary hood 28 (see turbine blades **34*a* and product matter 14*a* in area 150 in FIG. 4). The turbine blades release the product matter near the top of the stationary hood 28 adjacent the discharge hopper 36 of the mixing system 12 and the transition chute 90 of the reducing assembly 10 (see turbine blade 34*b* and product matter 14*b* in FIG. 4). Since the cover 38 over the discharge hopper 36 is closed the product matter does not fall into the discharge hopper 36 but slides over the top of cover 38. As the drum 20 continues to rotate in direction of arrow 37, the product matter is moved over the transition chute 90 of the reducing assembly (see turbine blades 34*c* and product matter 14*c* in FIG. 4). The arrangement of the transition chute 90 in relation to the turbine blades 34 is such that substantially all of the product matter 14 carried by each turbine blade 34 falls into the opened transition chute 90 of the reducing assembly 10 as indicated by arrow A in FIG. 2**.

The time necessary to accomplish complete and uniform mixing of the product matter 14 in the mixing system, 12 is dependent on the particulate size, density and weight of the product matter being mixed, as well as the load level in the mixing system 12. After the reducing assembly 10 has been operated for a long enough time period on the mixing system, all of the product matter 14 in the mixing system 12 will ultimately directed through the reducing assembly 10.

The reducing assembly transition chute 90 guides the product matter 14 through the receiving opening 84 and into the receiving area 92 of the main chamber 86 as indicated by arrow B. The product matter 14, influenced by gravity, continues to fall into the rapidly rotating rotor blades 110 whereby the product matter 14 is ground into its desired and generally uniform particulate size. The rotor blades 110, along with gravity, continue to drive the product matter 14 downward toward the rotating paddles 122. As the product matter passes through the main chamber 86, it is thrown outwardly against the inside surface 88 of the main chamber 86 by the rotating rotor blades 110, while also being driven violently downwardly from blade to blade. The flanges 114 on the outer ends of the rotor blades 110 aid in slicing through and breaking up the product matter 14.

Upon the product matter 14 traveling through the rotor blades 110, the paddles 122 contact the size reduced product matter and drive the size reduced product matter back into the drum 20 as indicated by arrows C. Due to the speed of rotation of the paddles 122, the product matter 14 tends to be propelled past the stationary hood 28 and toward the rear end wall (not shown) of the drum 20.

The reducing assembly 10 does not need to be operated continuously as the drum 20 is rotated in order to attain a blend of uniform consistency and size. Therefore, once uniform size reduction is accomplished, the chute door 94 over the transition chute 90 of the reducing assembly 10 is closed and the product matter 14 continues to be mixed until a uniform or desired blend is accomplished. Then, the cover 38 over the discharge hopper 36 is opened such that the turbine blades 34 release the product matter 14 into the discharge hopper 36 thereby removing the product matter 14 from the mixing system 12.

The present invention provides a structure and methodology for reducing the size of particulate matter being processed and mixed by a rotary drum mixer in a simple and efficient manner. The product matter does not need to be removed from the drum mixer for size reduction, and the reducing assembly may be mounted on an existing rotary drum mixer without significant modification of the mixer. The product matter, as it passes through the reducing assembly, is systematically and completely reduced in particulate size to a desired dimension, and the processed material is spewed out of the reducing assembly back into the interior of the rotating drum to be further mixed with the material in the drum. The reducing assembly is simple to operate and quite effective in achieving its stated objective—a reduction of particulate-matter to a generally uniform size to facilitate blending of such material in a rotary drum mixer.

Although the present invention has been described with reference to preferred embodiments, workers skilled in the art will recognize that changes may be made in form and detail without departing from the spirit and scope of the invention.

What is claimed is:

1. A mixing system for mixing product matter in a particulate form, the mixing system comprising:

a frame;

an open-ended drum rotatably supported by the frame;

a stationary hood enclosing the open-end of the drum;

a housing having a main chamber, the housing being mounted to the hood;

a guide chute attached to the housing and extending into the drum for guiding product matter from the drum into the main chamber of the housing;

a rotatable shaft positioned within the housing;

a plurality of bearings mounted about the shaft;

a plurality of blades attached to the shaft rotating within the housing thereby reducing the product matter therein to a generally uniform particulate size;

a seal chamber within the housing to seal at least one of the bearings from the main chamber; and discharge means for discharging product matter from the main chamber of the housing into the drum.

2. The reducing assembly of claim 1 wherein the housing is substantially cylindrical and is bisected into a first semi-cylindrical portion and a second semi-cylindrical portion, the second semi-cylindrical portion hingedly connected to the first semi-cylindrical portion.

3. The reducing assembly of claim 1 wherein the discharge means comprises:

a plurality of paddles rotatable to direct the product matter from the main chamber of the housing into the drum.

4. The reducing assembly of claim 1 wherein the housing has an inside surface, and wherein the plurality of blades comprise:

an outer flange adjacent to the inside surface of the housing.

5. The reducing assembly of claim 4 wherein:

the outer flange has a clearance within one-eighth inch of the inside surface of the housing.

6. The reducing assembly of claim 4 wherein:

the inside surface of the housing has a curvature; and the outer flange has a surface area with a curvature substantially equal to the curvature of the inside surface of the housing.

7. The reducing assembly of claim 1 wherein the plurality of blades comprise:

a body portion with a leading cutting edge extending perpendicular to the axis.

8. The reducing assembly of claim 7 wherein:

the body portion is tilted relative to the axis to assist in moving particular matter through the housing.

9. The reducing assembly of claim 7 wherein the blade further comprises:

an outer flange adjacent to the inside surface of the housing, the outer flange having a cutting edge which is a continuation of the leading cutting edge of the body portion.

10. The reducing assembly of claim 1 wherein the plurality of blades are coated with an abrasion resistant substance.

11. The mixing system of claim 1 wherein the housing is substantially cylindrical and the hood bisects the housing into a first semi-cylindrical portion and a second semi-cylindrical portion, the first semi-cylindrical portion positioned entirely within the drum and the second semi-cylindrical portion hingedly connected to the first semi-cylindrical portion.

12. The mixing system of claim 1 wherein the housing is mounted such that the main chamber is tilted off vertical.

13. The mixing system of claim 12 wherein the housing is mounted such that the main chamber is tilted off vertical at a 30° tilt angle.

14. The mixing system of claim 1 wherein the shaft is rotatable in excess of 1000 times as fast as the drum.

15. The mixing system of claim 14 wherein the shaft is rotatable at 3500 rpm and the drum is rotatable at 3 rpm.

* * * * *